United States Patent [19]

Doub, Jr.

[11] 4,281,969

[45] Aug. 4, 1981

[54] THERMAL PUMPING DEVICE

[76] Inventor: Ernest L. Doub, Jr., 4593 Orchard St., Montclair, Calif. 91763

[21] Appl. No.: 51,700

[22] Filed: Jun. 25, 1979

[51] Int. Cl.[3] ..... F04B 19/24

[52] U.S. Cl. ..... 417/52; 62/430; 62/467 PR; 62/510; 165/39

[58] Field of Search ..... 417/207–209, 417/52, 53, 54, 375; 165/32, 39; 62/48, 2, 430, 467, 510

[56] References Cited

U.S. PATENT DOCUMENTS

| | | | |
|---|---|---|---|
| 3,195,806 | 7/1965 | Bowen et al. | 417/52 |
| 3,732,690 | 5/1973 | Meijer | 123/1 A |
| 3,898,017 | 8/1975 | Mandroian | 417/209 X |
| 4,165,569 | 8/1979 | Mackay | 62/48 X |
| 4,165,952 | 8/1979 | Bennett | 417/207 |
| 4,185,979 | 1/1980 | Woolley | 62/48 |

FOREIGN PATENT DOCUMENTS

| | | | |
|---|---|---|---|
| 2017227 | 10/1979 | United Kingdom | 417/52 |

*Primary Examiner*—Carlton R. Croyle
*Assistant Examiner*—Edward Look
*Attorney, Agent, or Firm*—Boniard I. Brown

[57] ABSTRACT

A cell for pumping a fluid is provided, wherein the fluid is alternately heated and cooled by a transfer medium, and comprises a fluid-type chamber which communicates with a source of fluid via a one-way valve and with a sink for the fluid via another one-way valve, which valves allow flow only in the direction from the source into the sink. Heated thermal medium and chilled thermal medium are alternately admitted from respective sources to a heated transfer jacket about the chamber so that at least some of the fluid in the chamber is alternately cooled to reduce pressure to draw fluid from the fluid source via the one-way valve, and is heated to increase pressure to discharge pumped fluid to the sink via the other one-way valve. Where the pumped fluid is a gas, the cell pumps, or more specifically compresses, the gas and pumps it toward the sink. Where the pumped fluid is a liquid, the chamber arrangement is such that a gaseous fluid therein is prevented from passing through a liquid fluid therein, and is thus prevented from leaving the chamber upon increase of pressure of the gaseous fluid.

7 Claims, 3 Drawing Figures

THERMAL PUMPING DEVICE

BACKGROUND OF THE INVENTION

The present invention relates generally to thermally energized compressors and pumps for fluids, and more particularly to such devices employing pumping cells wherein the pumped fluid is alternately heated and cooled by a heated transfer medium.

In thermodynamic systems it is generally necessary to provide positive circulation of working fluid to pass the fluid through the system components which effect a thermodynamic working cycle. Where mechanical energy for this purpose is available from an outside source or is generated by the thermodynamic cycle and a portion diverted to the operation on mechanical pressure generators, the problem of fluid circulation is resolved. Examples of such arrangements are feedwater pumps of conventional Rankine-cycle steam engines driven off the shaft of the engine or turbine.

Provision for circulation of working fluid is more difficult where the thermodynamic cycle is to be operated without utilizing external energy or energy of the thermodynamic system to operate pressure generators. Instances wherein the working fluid changes phase from liquid to vapor, vapor pumps may be utilized to elevate the fluid to a header tank to provide static pressure, but where the working fluid is a gas, or where the working fluid is a liquid to be retained in the liquid state, mechanical devices or pressure generators are necessary in prior art systems.

A major problem is presented in many applications, such as those involving a corrosive fluid, systems wherein working pressure is substantially above or below atmospheric, or where leakage associated with seals utilized in mechanical pressure generators, cannot be tolerated. Thus, circulation of working fluid in sealed thermodynamic systems without utilizing mechanical pressure generators would make possible systems otherwise unfeasible in such fields as nuclear engineering or solar-powered thermal devices.

It is therefore an object of the present invention to provide compressor and pump means for fluid media operated by alternate heating and cooling of the media in a chamber of fixed volume, flow of the medium being governed by one-way valves operated by pressure changes in the chamber which are caused by the heating and cooling.

An object of the invention is revision for pumping of liquid media communicating with such chambers, and utilizing compressable gaseous fluid.

It is an object of the invention to provide firmly operated pumping cells for circulating working fluid in conventional thermodynamic cycles.

SUMMARY OF THE INVENTION

The foregoing objects, and other objects and advantages which will become apparent from the description of the preferred embodiments, are attained in a fluid pumping or compressing cell which is alternately heated and cooled by a heat transfer medium, each cell including a fluid-tight chamber in communication with a fluid source via a first one-way valve and with a fluid sink via a second one-way valve, the valves directing flow in the direction from the source and towards the sink. Heated thermal medium and cooled thermal medium from respective sources are alternately admitted to a heat transfer jacket about the chamber, so that fluid in the chamber is alternately cooled to lower the chamber pressure, thus to draw fluid from the source, and heated to increase the pressure in the chamber to discharge pumped fluid to the sink. Heat-transfer to the chamber is preferably aided by a baffle about the chamber, or by other means. In a thermodynamic system, such as a refrigeration or air-cooling system, a plurality of the of the compressor or pumping cells are utilized in a series-parallel arrangement between the fluid source and the sink for the fluid, the cells being typically connected between low-pressure and high-pressure headers of the working fluid. The duration of the alternating heating and cooling periods is affected by the volume of the chamber, the pressure differential between the low and high-pressure headers, and the heat transfer conditions between the thermal medium and the chamber interior.

Each cell conveys a volume of working fluid from the low-pressure header into the high-pressure header on each working stroke, such stroke comprising one heating period and one cooling period of the cell. The one-way valves respond to the pressure changes to permit flow in the direction from the low-pressure header to the high-pressure header, and control admittance of the working fluid to and from the chamber.

For applications wherein the working fluid to be pumped is liquid, chamber arrangements are provided for both the gaseous fluid and the liquid working fluid, the chamber arrangement being such that the gas is prevented from passing through the liquid to the second or outlet one-way valve, despite pressure changes in the gaseous fluid. The liquid and gas are in communication so that the pressure of the gas is applied to the liquid. In one embodiment, the gaseous fluid is trapped above the liquid, the liquid and gas being in communication. A liquid level-actuated valve may be provided to prevent escape of gas towards the high-pressure header, if it would otherwise be possible for gas pressure to expel all liquid from the chamber. A flexible diaphragm may be provided to separate the gas from the liquid in the chamber.

DESCRIPTION OF THE PREFERRED EMBODIMENT

Figure 1:
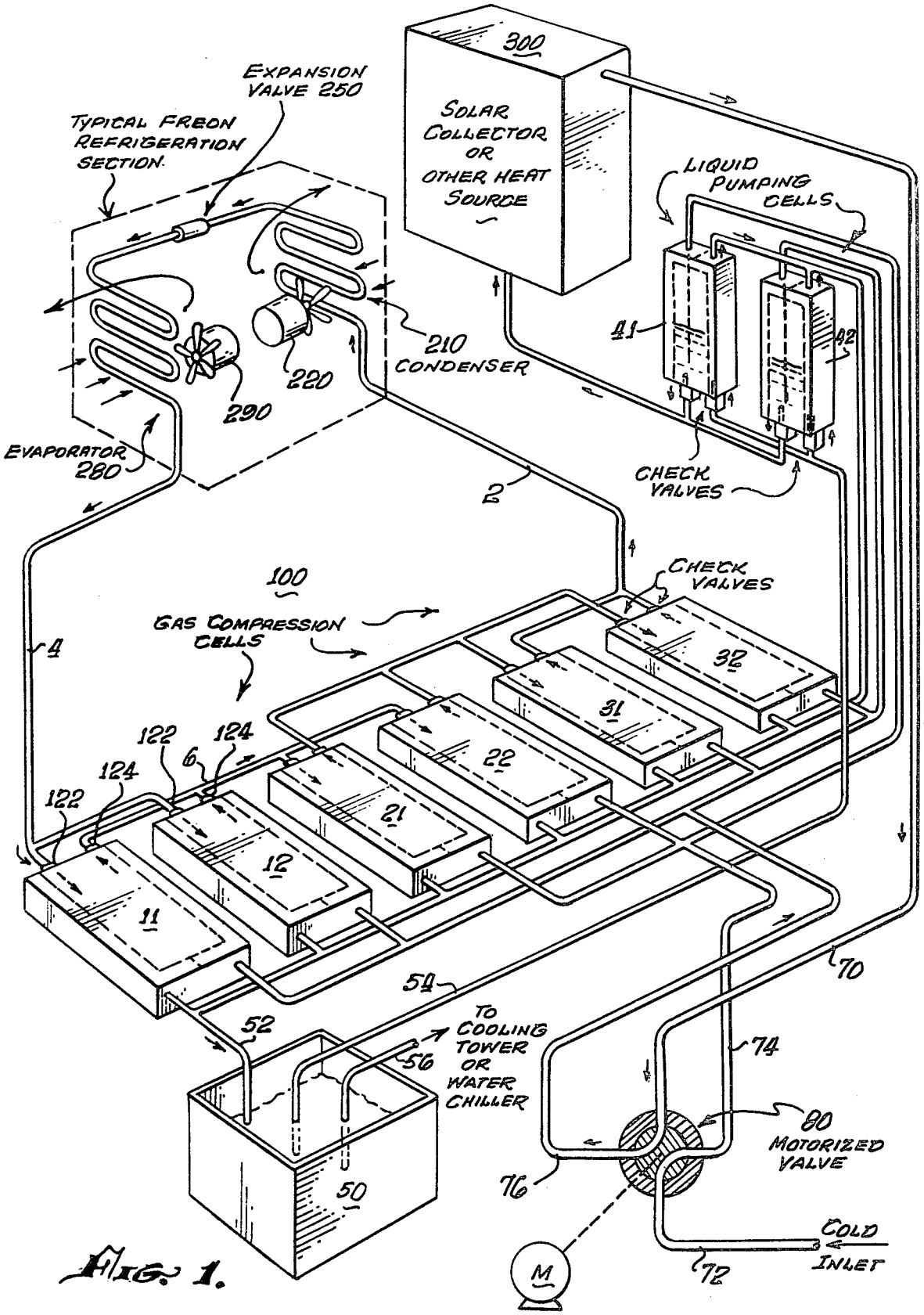
FIG. 1 is a perspective, partially schematic view, showing a plurality of pumping or compressor cells according to the invention in series-parallel arrangement in an inner-cooling or conditioning system wherein refrigerant fluid moves through condensing and expansion coils.

FIG. 1 illustrates a vapor-cycle air conditioning system employing a Freon-type refrigerant as the working fluid of a thermodynamic cycle. The term "Freon" will be understood to be a trademark for a group of polyhalogenated hydrocarbons containing fluoride and chlorine. The refrigerant is compressed in a compressor 100, comprising a plurality of cells according to the present invention, and its temperature is reduced in a condensing coil 210, provided with a fan 220. The refrigerant then passes through an expansion valve 250 and is evaporated in an evaporator 280 through which air is passed by a fan 290. The latent heat of evaporation for the phase change in coils 280 is supplied by the air passing through the coils, thereby producing a cooled discharge air stream from fan 290, which air stream is below the temperature of the air entering the evaporator.

The refrigeration section, including condensing coil 210, fan 220, expansion valve 250, and evaporator coil 280, is conventional.

Thermal compressor 100 generates pressure differentials between the high-pressure plenum, represented by condensor 210, and the low-pressure plenum represented by evaporator 280.

Compressor 100 comprises six pumping or compressor cells connected in pairs. Each pair comprises one of three sequential pumping stages. The first pumping stage includes pump cells 11 and 12, the second stage cells 21 and 22, and the third stage cells 31 and 32. The compressor 100 receives low-pressure refrigerant gas from a conduit 4 and discharges high-pressure refrigerant gas into a conduit 2 communicating with the condenser 210.

In operation of the compressor 100, the pumping or compressing cells are operated from galleries conveying a thermal medium, a liquid, vapor, or gas, which is pumped through heating and cooling devices utilizing pumping cells analogous to those employed in the compressor 100.

The thermal medium is heated in a heat source 300, which may be a conventional heater using a combustible fluid or, in a particularly advantageous embodiment, a solar heater intercepting the radiant heat of the sun and transferring that heat to the thermal medium circulating therethrough.

The thermal medium is cooled, in a device not shown, which may be analogous to the schematically represented heater 300, except that heat is removed from the thermal medium, as for example in a cooling tower exposed to atmospheric air.

The thermal medium is pumped about the high-temperature side of its loop by a pair of pumping cells 41 and 42, connected in parallel to form a single pumping stage. Thermal medium used in the pumping cells 41, 41 is discharged through a conduit 52 into a holding tank 50, and is drawn from that tank 50 via a conduit 54 to the pumping cells serving the heater 300, and via a conduit 56 into the pump device associated with the cooler.

Heated thermal medium returns towards the compressor 100 via a conduit 70, while cooled thermal medium is supplied via a conduit 72. Both conduits are connected to a rotary valve 80 with a valve plug 86 driven through suitable reduction gearing by a motor 82. It is the function of the motor 82 to rotate or oscillate the valve plug 86 in such a manner that conduits 74 and 76 are alternately brought into communication with the thermal medium supply conduits 70 and 72. In one position of the valve plug 86, the heated thermal medium in conduit 70 flows into conduit 76, while the chilled thermal medium in conduit 72 flows into conduit 74. In the other position of the valve plug 86 the interconnections are reversed, and conduit 74 receives the heated thermal medium while conduit 76 conveys the chilled thermal medium from valve 80.

It will be understood that the valve 80 and its drive are only shown schematically, and, that any arrangement of components which will achieve the desired hydraulic flip-flop effect at a preselected frequency or time interval lapse may be utilized in driving the compressing and pumping cells of the invention.

The conduit 76 is connected to the external shells of the pumping cells 11, 12, 31, 32, and 42-that is, to the first and third stages of the compressor 100, and to one of the two cells in the fluid pump associated with the heater 300. The conduit 74 is connected to the outer shells of cells 21, 22 and 41, including the second stage of the compressor 100 and the other pump cell in the hot water circuit. The pumping cells associated with the chilled water delivery line would similarly be connected to the conduits 74 and 76 conveying the thermal medium from the valve 80.

As hereinafter described with reference to FIGS. 2 and 3, the admission of the chilled medium to any particular cell corresponds to an intake stroke in a mechanical compressor, while the subsequent admission of heated medium corresponds to the discharge stroke.

Referring to the headers of the refrigeration loop of compressor 100, the conduit 4, which delivers low-pressure refrigerant from evaporator 280, is connected via one-way valves 122 with the inner chambers of cells 11 and 12, thus to prevent flow towards the evaporator. A discharge conduit 6 connects to the same inner chambers of the same cells via one-way valves 124. The same conduit 6 feeds the intakes of cells 21 and 22, and a further transfer conduit interconnects the discharges ports of these cells with the intakes of cells 31 and 32 in the third stage of the compressor 100. The discharge from each of the cells 31, 32 is fed directly into the conduit 2 and condensing coil 210. It will be understood that each intake and discharge conduit is provided with an appropriate one-way valve to permit flow into, and flow out of, respectively, the inner chamber of the pumping cell.

The compression produced in each stage of the compressor 100 is a function of the temperature ratio, in absolute units, attained in the gas mass contained within the inner chamber of each stage. Multiple stages may be required, as in the present instance, when substantial pressure ratios are to be generated and where the differences between the hot and cold streams of the thermal fluid are restricted by the available heating and/or cooling capacity. In general, where the volume of the system served by the compressor 100, or its cognates, is relatively large, the number of stages can be established by reference to the desired pressure levels and the available temperature limits. Where the volume of the system is small, it is preferable to have even numbers of stages, so that the first stage will be in a suction cycle when the last stage is discharging, thus to prevent excessive pressure fluctuations within the thermodynamic system served by the compressor of the invention.

Each stage may comprise one or more cells, depending on the throughput capacity of each cell which is, in turn, limited by the thermal inertia of the inner chamber. Cells of very large capacity may be impractical, or uneconomical, because of the relatively long times required to raise and lower the temperature of the gas mass contained within the inner chamber, unless means promoting rapid heat transfer are practicable.

Figure 2:
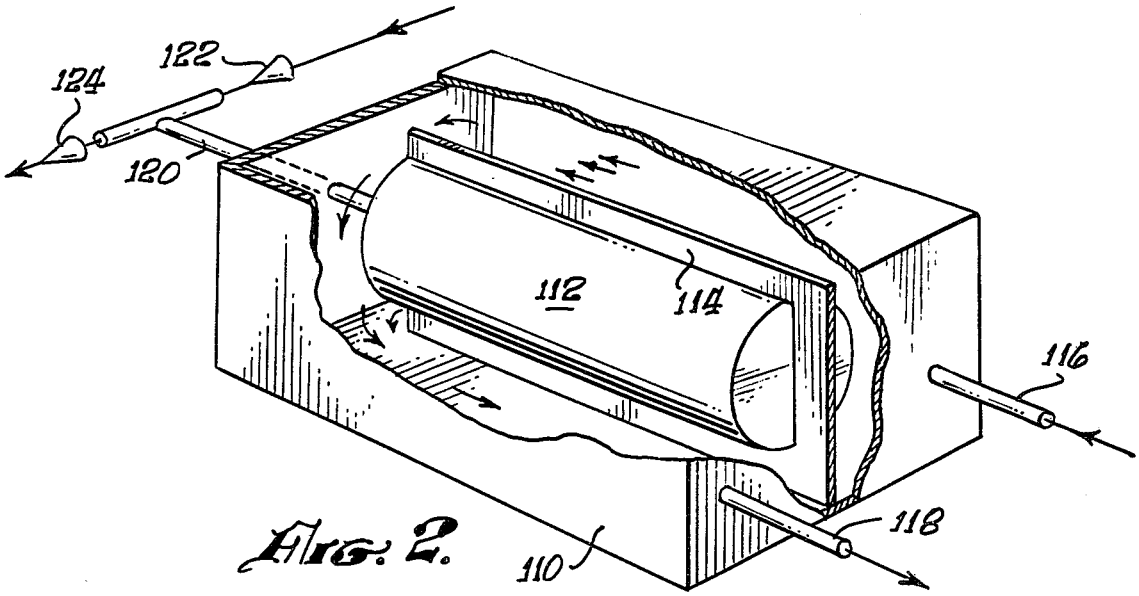
FIG. 2 is a perspective view, partially in section, of a pumping or compressor cell according to the invention, and employed in the system of FIG. 1.

FIG. 2 illustrates a representative form of a pump or compressor cell according to the invention, although the characteristics of such cells are variable over a wide range in their alignments, physical arrangements and other features. An external housing 110 has an inlet conduit 116 and a discharge conduit 118 for the thermal fluid employed in the compressor. An inner chamber 112 or housing, cylindrical in this embodiment, is mounted within an outer chamber which has planar sides defining a generally parallelepiped configuration 110, in such manner that the thermal fluid can freely circulate about and over the outer surface of the inner chamber 112. A baffle 114 mounted on the inner chamber directs a fluid stream of thermal medium about the inner chamber 112, as indicated by the directional arrows, from the inlet conduit 116, about the inner chamber housing 112, and to the discharge conduit 118, thus serving to improve and enhance heat transfer between the thermal fluid and the inner chamber 112.

A pipe 120 communicates with the interior of inner chamber 112, and has branches to communicate with an intake one-way valve 122 and a discharge one-way valve 124. The working fluid to be compressed is admitted into the inner chamber 112 through the valve 122 when the thermal medium cools the contents of the chamber, and the working fluid is discharged through valve 124 when the pressure within the chamber 112 is increased by the action of heated thermal medium. It is evident that the valves 122 and 124 may be directly connected through separate conduits to the interior of the chamber 112.

As previously indicated, the shapes and arrangements of the several components of the pump cell 11 are illustrative only. The inner chamber 112 may take any form and may be provided with heat-transfer fins, projections or convolutions both internally and externally; the external jacket for the thermal medium may, likewise, be adapted to a specific set of working conditions and thermal insulation may be provided on the thermal fluid jacket to prevent heat loss to, or gain from, the ambient atmosphere.

Figure 3:
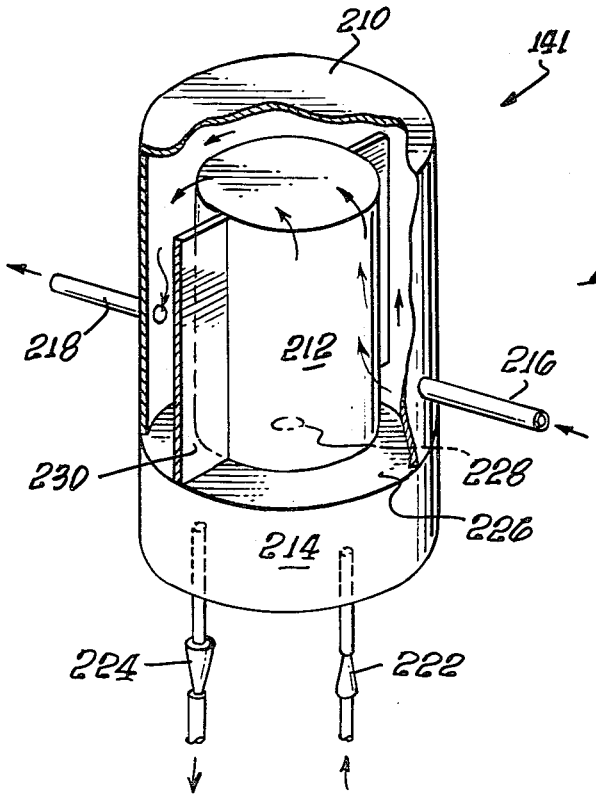
FIG. 3 is a perspective view, partially in section, of another embodiment of pumping cell according to the invention, which is adapted for liquid pumping.

FIG. 3 illustrates a pumping cell 141 for the pumping of a liquid working fluid. The liquid is admitted through a one-way valve 222 into a lower liquid chamber 214, and is discharged therefrom under higher pressure via one-way valve 224. A gas or inner chamber 212 is disposed above liquid chamber 214. The chambers are separated by a common wall 226 and are in fluid communication via an opening 228 in the wall. A baffle 230 on the inner chamber 212, like the baffle 114 of FIG. 2, serves to provide improved circulation of thermal medium about the inner chamber. The relative volumes of the two chambers are so adapted and arranged that gas in chamber 212 cannot pass through the liquid in the chamber 214 to communicate with the exit valve 224. Accidental discharge of the gaseous medium through the valve 224 is thus prevented, despite greatly increased temperature variations between the intake and discharge stroke, as the gas expands when heated by the circulation of heated thermal medium in the jacket 210.

The thermal medium is admitted into the jacket 210 through an inlet conduit 216 and exits through a conduit 218, its path intermediate between these conduits being channeled by a baffle 215 in the sense of the arrows shown.

As stated, the shapes and arrangements of the gas container 212, the liquid container 214 and the heat transfer jacket 210 are illustrative only. The use of separate liquid and gas chambers or containers may be avoided by the provision of level-sensing valves which prevent the lowering of the liquid level in the pump chamber below a preset level, or by the separation of the gas and liquid spaces within the same volume by the provision of a flexible diaphragm or gasbag. In instances where the gaseous expansion medium employed in the pump cell is insoluble in the liquid being pumped, and where the thermal cycle utilized in providing pumping actions is well controlled, it may be possible to dispense with any special provision for the prevention of gas discharge from the cell, and to have the surface of the liquid act as the seal for the gas within the same chamber, relying on gravity for separation.

As in the illustrative system of FIG. 1, the individual pump cells may be ganged in parallel for greater throughput, and grouped in stages for greater overall pressure increase. Many variations are possible in the interconnections of such cells. The number of cells may be reduced in successive stages of compression to compensate for the reduced volumes of the working fluid, for example. Parallel cells in any given stage may be connected to the supplies of heated and chilled thermal medium in a phased manner to provide for essentially continuous flow of the working fluid, compensating for the cyclic nature of the pumping action, as exemplified by the cells 41 and 42 in the system of FIG. 1, representing a single pumping stage but connected to operate 180 degrees out of phase. The form and operating means of the valve 80, or its functional equivalents may be varied to adapt the distribution of the two thermal medium streams to any given combination of pumping cells.

It is contemplated that the principal application of the pumping cell of the invention will be in air conditioning systems employing Freon-type refrigerants, with the thermal medium heated by a solar collector and cooled by cooling towers; it is also foreseen that the thermal medium will be water or a solution of glycol-based liquids in water. It is also contemplated that the pumping cell may be utilized in any other system to pump gases or liquids, and with thermal media suited to the particular application.

The inventor claims:

1. A cell for pumping a first fluid, and which cooperates with an associated heat sink, an associated heat source, and associated first and second heat transfer fluids, which comprises:

means for alternately heating and cooling the first fluid with the second fluid, first and second one-way valves, said means for alternately heating and cooling comprising a fluid chamber in fluid communication with the heat source via said first one-way valve and communicating with the associated heat sink via said second one-way valve, said first and second one-way valves permitting flow of said first fluid only in a direction from the associated heat source and toward the associated heat sink, a heat transfer jacket disposed about said chamber for directing circulation of the second fluid about said chamber, and means for alternately admitting heated and cooled second fluid to said jacket, whereby at least some of the first fluid in said chamber is alternately cooled to reduce pressure in the chamber to draw pumped first fluid thereinto via said first one-way valve, and heated to increase pressure therein to discharge pumped first fluid via said second one-way valve.

2. A cell according to claim 1, further including:

baffle means adjacent to said chamber to improve heat transfer with respect to a thermal medium.

3. A cell according to claim 1, wherein:

the second fluid is a liquid, and said first fluid disposed within said chamber is partly gaseous and partly liquid and said cell includes means for preventing the gaseous fluid from passing through the liquid second fluid to said second one-way valve, despite the alternate increase and reduction in the pressure in said chamber, said means for preventing not including any physical wall member intermediate the liquid and the gas.

4. A cell according to claim 3, wherein:

said means for preventing includes a liquid section and a gas section in said chamber, said liquid and gas sections being in fluid communication and the pressure in said gas section being substantially the same as the pressure on said liquid in said liquid section.

5. A cell according to claim 4, wherein:

said liquid section is disposed at a higher elevation then said gas section, and said liquid and gas sections communicate via an opening in a common wall above the liquid section.

6. A system for pumping a fluid, comprising:

a source of a first fluid, a source of a second fluid, a heat sink for said second fluid, a heat source for said second fluid, a first plurality of cells disposed in series relationship and a second plurality of cells disposed in mutually parallel relationship, one of said pluralities of cells being disposed in fluid communication with the other of said pluralities of cells to move the second fluid into at least one cell in the other plurality of cells, each of said cells in at least one of said pluralities of cells comprising means defining a fluid-tight chamber disposed in fluid communication with said heat source via a first one-way valve and in fluid communication with said heat sink via a second one-way valve, said one-way valves permitting flow of said first fluid only in a direction from said heat source and toward said heat sink, and a heat transfer jacket about said chamber for circulation of said second fluid therethrough and about said chamber, and means for alternately admitting heated second fluid and chilled second fluid to said jackets, whereby said first fluid in said cell chambers is alternately cooled to reduce pressure in said chamber to draw said first fluid inwardly and heated to increase pressure therein to discharge compressed first fluid.

7. A system according to claim 6, wherein:

said second fluid is a liquid, and each of said chambers contains said first fluid in both a gaseous and a liquid state, said chambers including means for preventing gaseous fluids from passing through the liquid second fluid to said second one-way valve, despite the increase and reduction in the gas pressure.

* * * * *